United States Patent [19]

Korger

[11] 4,375,714

[45] Mar. 8, 1983

[54] RELEASABLE LOCKING MECHANISM FOR SAFETY BELTS

[75] Inventor: Heinz Korger, Niederstotzingen, Fed. Rep. of Germany

[73] Assignee: Carl Stahl GmbH & Co., Herbrechtingen, Fed. Rep. of Germany

[21] Appl. No.: 160,220

[22] Filed: Jun. 17, 1980

[30] Foreign Application Priority Data

Jun. 18, 1979 [DE] Fed. Rep. of Germany ..... 2924509
Apr. 28, 1980 [DE] Fed. Rep. of Germany ..... 3016327

[51] Int. Cl.[3] ..... A44B 11/26
[52] U.S. Cl. ..... 24/230 AL
[58] Field of Search ..... 24/230 AL, 230 A, 230 AK, 24/230 R

[56] References Cited

U.S. PATENT DOCUMENTS 4,004,115 1/1977 Esner ..... 24/230 AL X
4,065,836 1/1978 Stephenson ..... 24/230 AL X
4,100,657 7/1978 Minolla ..... 24/230 AL
4,197,619 4/1980 Burleigh ..... 24/230 AL

*Primary Examiner*—Robert P. Swiatek
*Attorney, Agent, or Firm*—Toren, McGeady and Stanger

[57] ABSTRACT

A releasable locking mechanism for safety belts including a lock tongue connected with the end of one belt member and a casing connected with the end of a second belt member operates with a locking bolt slideably guided on a support surface to engage and disengage a stop surface on the lock tongue for locking and releasing the safety belt. A spring loaded release member urges the locking bolt along the support surface to release the lock tongue from locking engagement therewith. The support surface is defined on the casing to extend transversely relative to a planar slot within which the lock tongue is inserted and the stop surfaces on the lock tongue and the support surface upon which the locking bolt slides are arranged to define therebetween an acute angle.

28 Claims, 14 Drawing Figures

FIG. 10
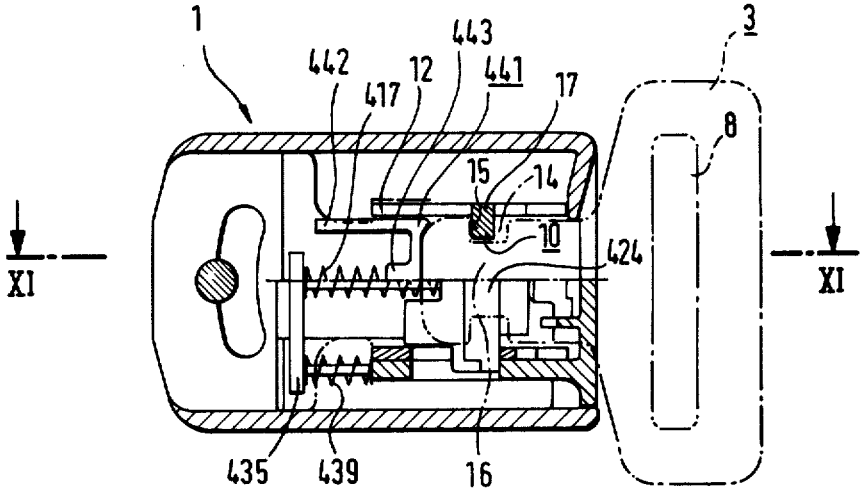
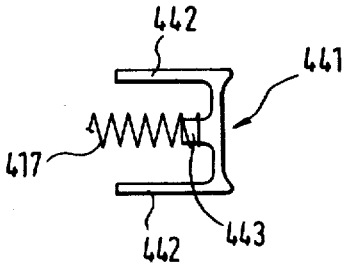
FIG. 14

RELEASABLE LOCKING MECHANISM FOR SAFETY BELTS

The present invention relates generally to safety belt devices and more particularly to a releasable locking mechanism for such devices.

The invention is more particularly directed toward a locking mechanism which involves a bolt member mounted so that it is capable of a swivelling and sliding movement in the lock casing of the locking mechanism about an axis which is directed transversely to the insertion direction of a lock tongue which is attached at one end of one of the two belt members which are to be locked together. The present invention relates to the type of mechanism wherein the bolt member engages when in the locked position with at least one bolt projection in at least one recess of the lock tongue. The mechanism of the invention is of the type wherein a stop surface of the lock tongue engages the bolt projection with the bolt member being lifted by operation of a spring loaded release member out of the recess of the lock tongue.

In prior art devices of safety belt locking mechanisms, the forces acting on the belt give rise to frictional forces operating directly with regard to the opening force of the lock so that difficulty can be encountered when a lock mechanism is to be opened. This may occur for example after an accident when the belt is subject to the body weight of a person using the belt.

Accordingly, the invention is directed toward providing a locking mechanism of the type described above for safety belts wherein the smallest number of individual parts may be utilized to produce an operative mechanism and wherein, consequently, the mechanism may be easy to manufacture. Furthermore, the invention is directed toward a locking mechanism wherein an extremely small opening force, even when the lock tongue of the belt is under a tensile load, may operate to unlock the belt. The invention aims to provide a locking mechanism which will not be subject either to the danger of involuntary opening due to transverse acceleration, shock or impact stresses or to the danger of a merely partial lock-in of the locking tongue and which, therefore, may be easily and reliably opened with safety.

The invention provides a lock casing which may be of generally flat construction and which exhibits optimum functional safety. The invention is intended to provide a mechanism which is appropriately constructed for high requirements with regard to maximum tensile stress of the locking tongue as well as to impact resistance. Additionally, the invention is directed toward a device wherein care is taken so that the insertion opening for the locking tongue will be closed when the lock is not used in order to prevent penetration of dirt and dust into the lock.

SUMMARY OF THE INVENTION

Briefly, the present invention may be described as a releasable locking mechanism for safety belts comprising lock tongue means connected with the end of a first belt member, casing means connected with the end of a second belt member, means defining a generally planar slot for receiving said lock tongue means, stop surface means formed on said lock tongue means, support surface means defined on said casing means extending transversely relative to said planar slot, locking bolt means slideably guided on said support surface means and adapted to extend to within said planar slot to engage said stop surface means to lock said tongue means relative to said casing means, and a spring loaded release member adapted to urge the locking bolt means along said support surface means to release the lock tongue means from locking engagement therewith.

The stop surface means defined on the lock tongue means and the support surface means are arranged relative to each other to define an acute angle therebetween.

Thus, the basic features of the invention are achieved in that the stop surface of the lock tongue means forms an acute angle with the support surface means supporting the bolt means basically transverse to the insertion plane of the lock tongue means in the lock casing in a slideable manner. Beginning from an alignment of the stop surface and the contact surfaces of the bolt member, directed vertically to the insertion plane of the lock tongue, an increasing inclination of the supporting surfaces of the bolt member relative to the insertion plane of the lock tongue will produce an increase in the component forces resulting from tension and acting on the lock tongue and directed in the direction of lifting of the bolt projection of the bolt member out of the stop surfaces of the lock tongue until the angle of inclination of the supporting surfaces of the bolt member has become so flat with regard to the insertion plane that the component of force that can be derived from the tension effective from the lock tongue corresponds in size merely only to the frictional forces operating against the position of the bolt member in the opening direction. Therefore, with a suitable selection of the angle of inclination of the supporting surfaces relative to the stop surfaces of the locking tongue, any increase of the release force required at the release member of the construction according to the present invention may be completely excluded due to a tension which is effective at the lock tongue. Moreover, even with a small angle of inclination between the stop surface means of the lock tongue and the supporting surface means supporting the bolt member in the lock casing, a force component effective in the releasing direction of the bolt member will already result from the tension acting on the lock tongue by means of which the release force necessary at the release member is decreased in dependence upon the height of the tension acting on the lock tongue. When the angle of inclination between the stop surface means of the lock tongue and the supporting surface means exceeds an angle at which the angles between the bolt member and the stop surface means of the lock tongue or supporting surfaces in the lock casing are equal, which is the so-called equilibrium angle, a device must be assigned to the bolt member in order to secure it in its locking position.

Inasmuch as the angle of inclination between the supporting surface means for the bolt member on the lock side and the stop surfaces of the lock tongue does not correspond to the equilibrium angle, a safety member is assigned to the bolt member which is slideable by means of the release member in a plane parallel to the plane of insertion of the lock tongue, the plane intersecting with its path of movement. This safety member is constructed for example in the shape of a bar and it may be connected by means of suitable connecting parts with the release member of the lock.

In order to exclude the possibility of partial locking, the invention provides that the bolt member in a direction to its release position have a flat spring which is fixed at a distance relative to its plane of movement at the lock casing and which engages with its free end at the bolt member. The spring tension of the flat spring is acted upon at least equal to the sum of the frictional forces operating against an adjustment of the bolt member in its release position. The flat spring acting upon the bolt member according to the invention in the direction of its release position prevents with a positive action the possibility of a partial locking of the bolt member because the bolt member would be pressed into it release position by force of the flat spring if such a position should occur. The force of the flat spring acting upon the bolt member in the direction of its release position must be dimensioned in such a way that it can overcome the frictional forces which, on the one hand, are affected by the ejection spring for the lock tongue and result at an appropriate position of the bolt member between the stop surfaces of the lock tongue and the bolt projection, and those between the upper edge of the bolt member and a safety member, arranged longitudinally slideable in the lock casing, which may be effected by the key spring of the release member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 10 is a top view of a special embodiment of the locking mechanism according to the invention, shown partially in section;

FIG. 14 is a top view showing an individual part of the locking mechanism according to FIGS. 4–7.

DETAILED DESCRIPTION OF THE PREFERRED EMBODIMENTS

Figure 2:
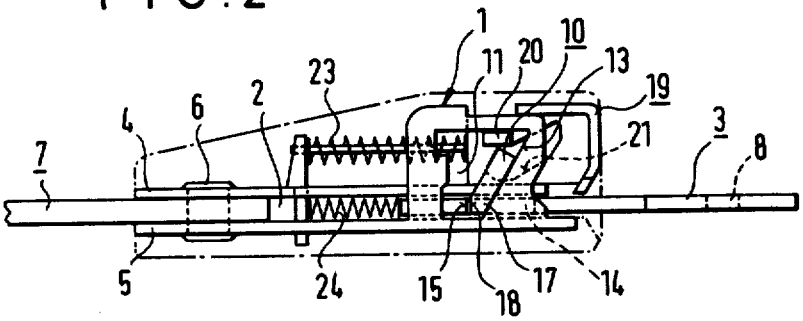
FIG. 2 is a schematic side view of the locking mechanism of FIG. 1.
Figure 1:
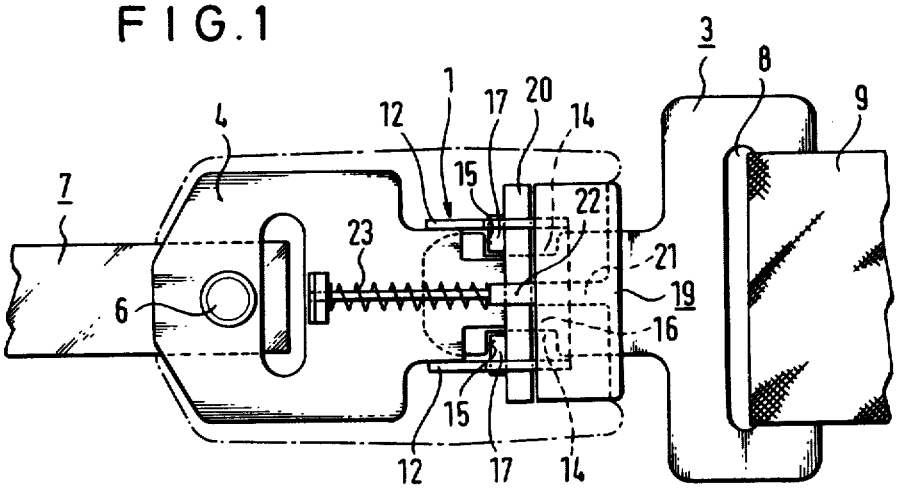
FIG. 1 is a top view of a locking mechanism structured in accordance with the present invention shown with the lock tongue inserted in locking position.
Figure 3:
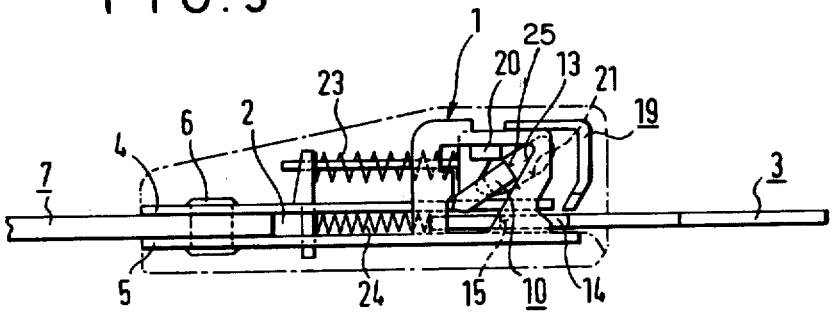
FIG. 3 is a schematic side view of the locking mechanism of FIGS. 1 and 2 shown while the lock tongue is being inserted.

Referring now to the drawings wherein similar reference numerals are used to refer to like parts throughout the various figures thereof, a first embodiment of a locking mechanism constructed in accordance with the present invention is depicted particularly in FIGS. 1–4. In FIG. 2, the locking mechanism is shown in the locked condition. In FIG. 3, the mechanism is shown while one end of the seat belt is being inserted into locking engagement. And in FIG. 4, the device is shown, during a releasing operation.

A lock casing for the mechanism of the invention is generally identified with reference numeral 1 and is formed with two parallel guidance surfaces 4 and 5 which define a guidance insert slot for a lock tongue 3 having one belt end 9 attached thereto. The members 4 and 5 are attached by means of a rivet or a similar holding device and a second belt end 7 is joined thereto by the rivet 6.

The lock tongue 3 is formed with an opening 8 within which the belt end 9 is connected and in the embodiment shown in FIGS. 1–4, a bolt member 10 operates as the essential locking element of the device. The bolt member 10 is supported within the lock casing 1 so as to be capable of a swivelling movement as well as a sliding movement. The casing 1 is formed with sliding support surfaces 13 which define part of recesses 11 formed in the lateral walls 12 of the casing 1. The supporting surfaces 13 extend at an acute angle relative to the insertion plane of the guide slot 2 through which the lock tongue is moved for locking and unlocking action with the casing 1.

The locking tongue 3 is formed with a pair of lateral recesses 14 on either side thereof with stop surfaces 15 being formed to define the forward sides of the recesses 14. The stop surfaces 15 are aligned to extend transversely to the insertion direction of the lock tongue 3.

The bolt member 10 is formed with two bolt projections 17 which engage a neck 16 of the insertion tongue 3 in a fork-shaped manner, with the bolt member as a whole being formed from a blank of generally flat material. The bolt projections 17 of the bolt member 10, at the side thereof facing the stop surfaces 15, are provided with a bevel 18 which extends in a locking position of the bolt member 10, shown in FIG. 2, parallel to the stop surfaces 15 of the lock tongue 3.

In the embodiment shown in FIGS. 1–4, the inclination of the supporting surfaces 13 relative to the stop surfaces 15 of the lock tongue 3 is selected in such a manner that the component of force resulting from tension applied to the lock tongue 3 and urging the bolt member 10 in the lifting direction is not completely sufficient to insure, during actuation of releasing operation of the mechanism, automatic disengagement of the bolt projections 17 from the lock surfaces 15 of the lock tongue 3.

As will be seen from the drawing, the mechanism includes a release member 19 which is actuated to effect disengagement of the locking mechanism by movement of the release member 19 inwardly or to the left as seen in FIGS. 1–4.

The release member 19 has rigidly connected thereto a bar-shaped safety member 20 and during actuation of the release member 19 the safety member 20 is moved in a plane parallel to the insertion plane of the lock tongue 3 and intersecting the plane of movement of the bolt 10. The safety member 20 secures the bolt member 10 at the inserted lock tongue 3 in its locking position.

Additionally, a control curve 21 is connected with the center of the release mechanism 19 having a control surface 22 which during actuation of the release member 19 engages with an appropriate central opening of the bolt member 10, not shown in the drawing, and which during actuation of the release member 19 produces an additional force which pulls the bolt member 10 out of its locking position.

Figure 4:
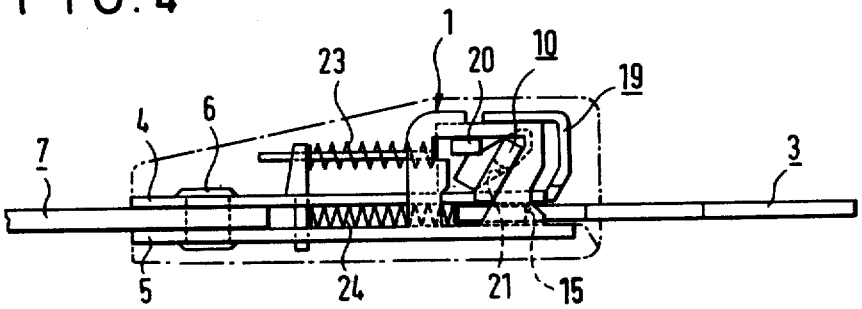
FIG. 4 is a schematic side view of the locking mechanism of FIGS. 1 and 2 shown during releasing operation.

For this purpose, as will be seen especially in FIGS. 2 and 4, the inclination of the control surface 22 relative to the insertion plane of the lock tongue 3 is smaller than the inclination of the supporting surfaces 13. A pressure spring 23 assigned to the release member 19 applies a spring force which is directed opposite to the direction of release movement of the member 19. The pressure spring 23 is also stressed during insertion of the lock tongue due to the swivelling movement of the bolt member 10. The spring again becomes slack during engagement of the stop surfaces 15 of the lock tongue 3 and therefore forms an audible engagement indication.

Additionally, an ejection spring 24 is assigned to the lock tongue 3 and is aligned parallel with the insertion slot 2.

In the operation of the embodiment of the invention depicted in FIGS. 1–4, during insertion of the lock tongue 3 into the lock casing 1, or into the guidance slot 2, the bolt member 10 will be swivelled about its upper edge 25 so that the insertion guidance slot 2 for the lock tongue 3 is completely released. However, at the same time, the spring 23 is stressed until the bolt member 10 with its bolt projections 17 engages behind the stop surfaces 15 of the lock tongue 3. In this way, the bolt member 10 swivels back to a position parallel to the supporting surfaces 13 in the lock casing 1. When the lock tongue 3 has been completely inserted into the slot 2, the bolt member 10 will be in a position such as that depicted in FIG. 2 and it will be secured in this position by the safety member 20 which will prevent sliding of the bolt 10 along the supporting surfaces 13.

The safety member 20 is guided along a plane parallel to the insertion plane of the lock tongue 3 and intersecting with the plane of movement of the bolt 10. The safety member 20 can be moved by means of the release member 19 out of the plane of movement of the bolt member 10.

In order to open the belt lock, as shown in FIG. 4, the release member 19 is moved inwardly whereby the safety member 20 is first moved out of the plane of movement of the bolt member 10, specified by the supporting surfaces 13 so that the bolt member 10 may be moved upwardly without impediment.

As long as a tension is applied to the belt end 9, and as long as this tension prevails at the lock tongue 3, a component of force resulting from the inclination between the stop surfaces 15 of the lock tongue 3 and the supporting surfaces 13 of the casing 1 will result which moves the bolt member 10 in a disengaging direction. This component of force effects by itself a release of the bolt member 10 or its bolt projection 17 from the area behind the stop surfaces 15 of the lock tongue 3.

Since at the inclination of the supporting surfaces 13 relative to the stop surfaces 15, shown in the drawings, a component of force effecting opening or releasing of the bolt member 10 and resulting from the tensile load on the lock tongue 3 is probably not sufficient to move the bolt member in the opening direction against the frictional forces which will be acting upon it, a curved control surface 21 is arranged in the center of the release member 19 and this curved control surface engages beneath a central recess in the bolt member 10 during the time that pressure is applied to the release member 19. The control surface 22 has a smaller angle of pitch relative to the insertion plane of the lock tongue 3, so that the release movement of the bolt member 10, extending along the supporting surfaces 13, is supported by the control curve 21 connected with the release member 19.

Figure 5:
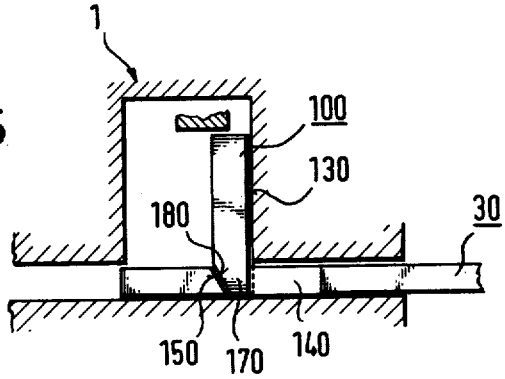
FIG. 5 is a schematic representation of another embodiment of the invention.

In an especially preferred embodiment of the invention it is provided that the supporting surfaces, supporting the bolt member in the lock casing, enclose with their insertion planes in the insertion direction of the lock tongue an acute angle and that the stop surfaces of the lock tongue recess are aligned vertically relative to the insertion plane. In this embodiment of the invention shown in FIG. 5, supporting surfaces 130 which support a bolt member 100 in the lock casing 1 are aligned vertically relative to the insertion plane of the lock tongue 30. Stop surfaces 150 of the lock tongue recess 140 and surfaces 180 of the bolt projections 170 of the bolt member 100 facing the recess enclose an acute angle inclined with respect to the insertion direction of the lock tongue 30, with the insertion plane of the lock tongue 30. This embodiment of the invention has the advantage that the lock tongue and especially its supporting surfaces are aligned vertically relative to their own plane as well as to the insertion plane and thus they can be manufactured especially easily.

Figure 6:
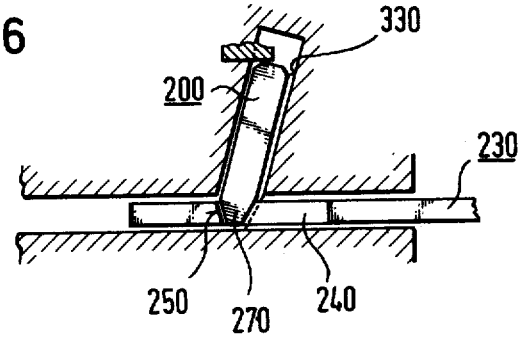
FIG. 6 is a schematic representation of a further embodiment of the invention.

In the embodiment of the invention depicted in FIG. 6, a bolt member 200 is formed with bolt projections 270 which have a wedge-shaped cross-sectional configuration. Stop surfaces 250 of a lock tongue recess 240 and supporting surfaces 330 at the lateral walls of the lock casing 1 are arranged aligned in the opposite direction in such a way that they enclose with the insertion plane of the lock tongue 230, aligned in the opposite direction, an acute angle with the insertion plane of the same.

In order to at least theoretically exclude partial locking of the lock tongue, which is possible in such a lock construction, the bolt member is acted upon in the direction of its release position by a flat spring 419. The flat spring 419 is attached at 420 at the rear end of the lock casing 1 at the upper plate 4 of the insertion guidance slot 2 for the lock tongue 3.

Figure 9:
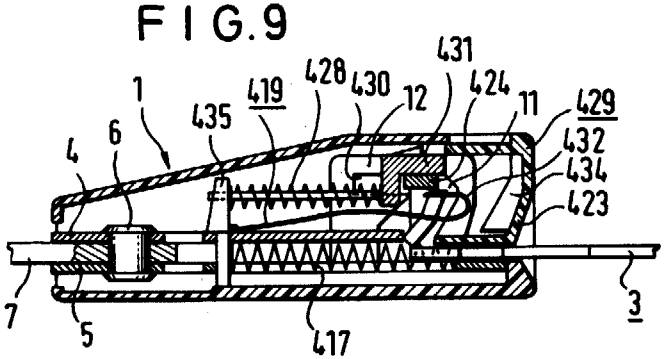
FIG. 9 is a longitudinal sectional view according to FIG. 2 showing the locking mechanism while the lock tongue is being inserted into locking position.
Figure 8:
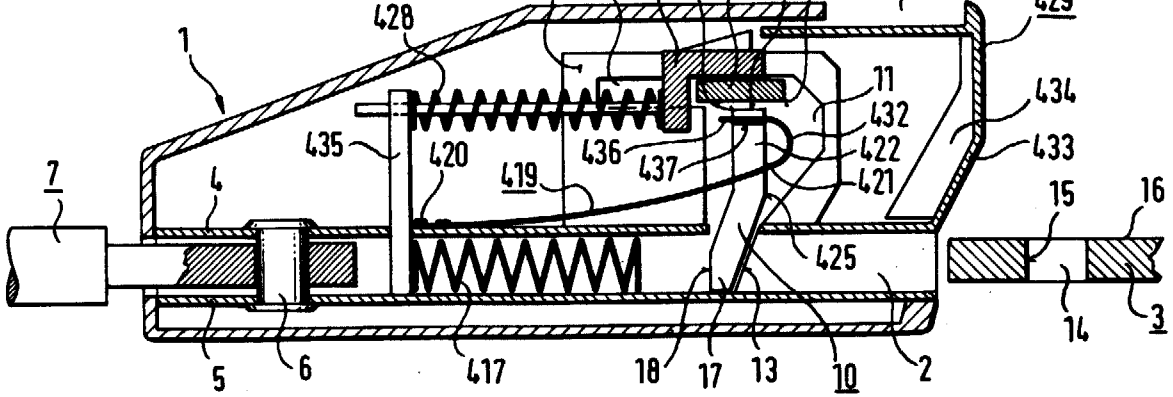
FIG. 8 is a longitudinal sectional view through the lock mechanism according to FIG. 1 shown while the lock tongue is not in its inserted position.

With its free end 421, the flat spring 419 engages around the upper area 422 of the bolt member 10 with a distance corresponding at least to the material thickness of the lock tongue 3, from its upper frontal surface 423. The length of the flat spring, as will be seen from FIGS. 8 and 9, is several times the height of the bolt member 10. The flat spring, commencing from its attachment point at 421 and continuing at an increasing distance from this point, is increasingly arched or bent upwardly and exercises upon the bolt member 10 a force directed toward its release position. The bolt member, overcoming the maximum frictional forces possible during a partial locking position between the bolt member and the lock tongue or bolt member and safety member 424, is moved with a positive action into this release position.

Figure 7:
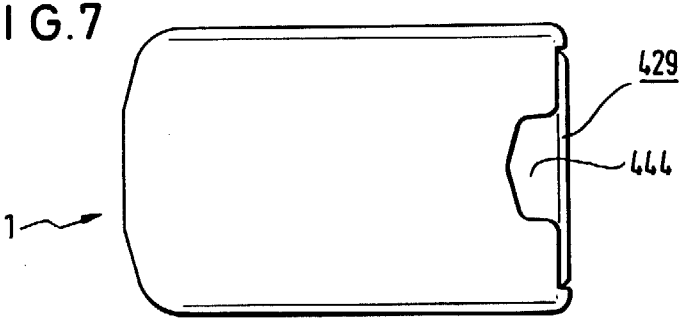
FIG. 7 is a top view of the lock mechanism of the invention.

Particularly, a belt lock shown in accordance with FIGS. 7–9, has a bolt member 10 which is bent beyond its height at 426 wherein the bolt member 10 at 426 is bent in such a way that its upper frontal surface 423 always remains parallel relative to the underside of the safety member 424 at least during release from its locking position. During release of the lock, the frontal surface 423 of the bolt member 10 will therefore always enclose with the underside of the safety member 424 a right angle. In this way, it may be accomplished that during adjustment of the safety member 424 the bolt member 10 will be stopped in its locking position until the front edge 426 of the safety member 424 is moved over the rear edge 427 of the frontal surfaces 423 of the bolt member 10.

In the simplest embodiment shown in FIGS. 8 and 9, the safety member 424 is acted upon by a pressure spring 428 supported against a wall of the lock casing 1 which may be disengaged by means of the release member 429 against the effect of the pressure spring 428 with the upper frontal surface 423 of the bolt member 10. The pressure spring 428 acts upon the safety member 424 as a result of intervention of a spring extremity shoe 431 where the release member 429 of the lock also engages. At its front end 432, projecting forwardly beyond the bolt member 10, the flat spring 419 is arched according to the embodiment shown in FIGS. 7 and 8 and is bent obliquely upwardly in accordance with the embodiment shown in FIGS. 11–13. In each of these two embodiments, there is assigned to the front end 432 of the flat spring 419 a web 434 which extends in the longitudinal direction of the release member 429 and which is aligned vertically relative to the release member front wall 433 and increases from top to bottom in a wedge shape. With the help of this web 434, the bolt member 10 may be lifted into its release position if necessary by the bent or arched front end of the flat spring 419 even if the ejection spring 24 for the lock tongue 3 is broken.

In the embodiments shown in FIGS. 8 and 9, recesses 11 are assigned to the bolt member 10 in the lateral walls 12 of the casing. The paths of the outlines of the edge of these recesses are curved corresponding to the path of movement of the bolt member 10 traced by the flat spring 419 holding the bolt member 10 and directed essentially in an arch-shaped configuration and vertically. The path of these edge outlines will form the supporting surfaces for the bolt member 10. The possible path of motion of the bolt member 10 results first from the length of the flat spring 419 and secondly from its arched configuration wherein the actual path of motion of the bolt member 10 during engagement or disengagement from its locking position is formed by the overlapping of the changes in form of the flat spring 419 with a curved path corresponding to its length. Recesses 11 in the lateral walls 12 of the casing forming the supporting surfaces for the bolt member 10 have, in connection with an area forming an acute angle with the insertion plane of the lock tongue 3 and directly above the insertion guidance slot 2 for the lock tongue 3 in the same inclination direction, an essentially flatter angle relative to the insertion plane of the lock tongue 3 in order to also guarantee easy opening of the bolt member 10 after a peak load upon the lock.

Figure 13:
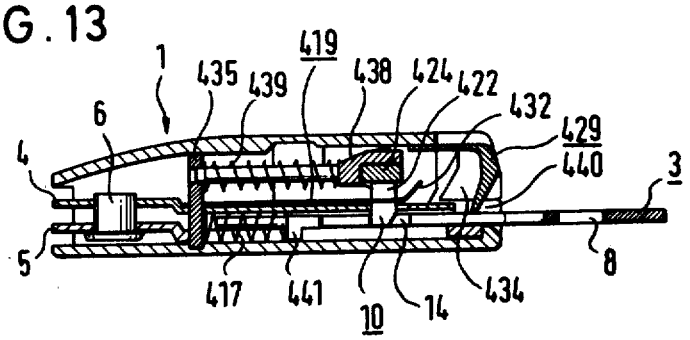
FIG. 13 is a sectional view according to FIG. 5 showing the mechanism while the lock tongue is engaged in locking position.
Figure 12:
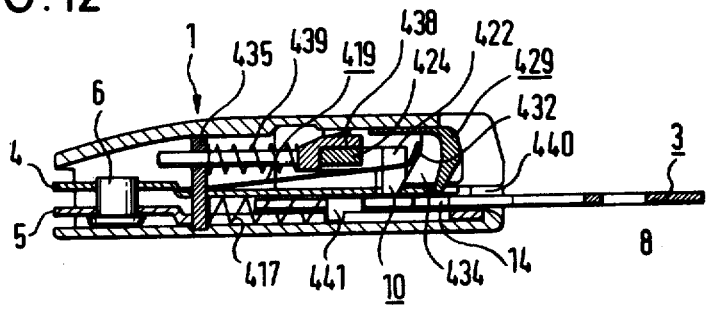
FIG. 12 is a sectional view according to FIG. 5 showing the locking mechanism while the lock tongue is inserted.
Figure 11:
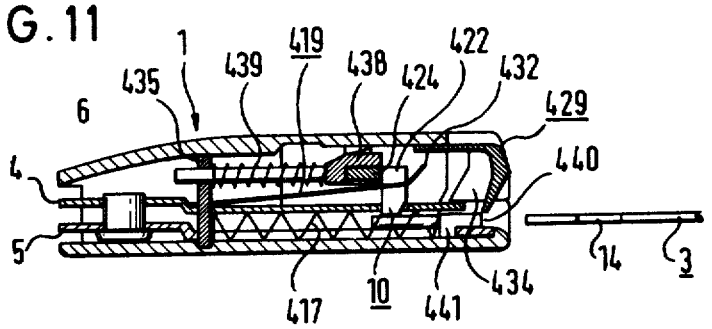
FIG. 11 is a sectional view according to FIG. 4 taken along the line XI—XI of FIG. 10 shown before the lock tongue is inserted.

As will be seen especially in the embodiments of FIGS. 11–13, the lock casing 1 has a U-shaped planar form having two legs formed by the lateral walls 12 of the lock casing and its base by a supporting plate 435 equal in height to the lateral walls 12 of the lock casing and supporting the ejection spring 24 for the lock tongue 3 and the pressure spring 428.

It is further provided in the embodiment shown in FIGS. 8 and 9 that the free end 432 of the flat spring 419 by means of tabs 436 bent backwardly with respect to the fixing means 420 of the flat spring 419 on the side of the lock casing is in contact with the surfaces 437 which are parallel to the upper frontal surface 423 of the bolt member 10. In this manner, an absolutely parallel and non-canted guidance of the upper frontal surface 423 of the bolt member 10 during its approach to the plane of motion of the web-plate shaped safety member 424 is insured.

In the embodiment shown in FIGS. 10–13, the flat spring 419 is formed as a straight leaf spring so that the bolt member 10 during swivelling of the flat spring 419 about its clamping point 421 will be guided in an essentially vertical plane. In this embodiment, the bolt member 10 is held in its release position by the force of the flat spring 419. In order to reduce the structural height of the locking mechanism as much as possible, even where especially large material thicknesses of the bolt member 10 are involved, it is provided in this embodiment in addition to an exact vertical adjustment plane of the bolt member 10 that the safety member 424 be arranged adjacent to the upper area 422 of the bolt member 10 while the bolt member 10 is in its release position. In this embodiment of the invention, the safety member 424, due to intervention of a spring extremity shoe 438, is acted upon by two pressure springs 439 arranged symetrically relative to the longitudinal center axis of the belt locking mechanism wherein the two springs 439 are supported at the supporting plate 435 of the lock casing 1. This arrangement of pressure springs 439 acting as key springs guarantees simultaneously a totally symmetrical admission of the safety member 424 whereby possible inclination or canting of the safety member with respect to the bolt member 10 will be definitely avoided. To close the insertion opening 440 for the lock tongue 3, in the embodiment shown in FIGS. 10–13, a sliding member 441 connected before the ejection spring for the lock tongue is provided operating to close the insertion opening 440 when the lock tongue 3 is not inserted into the lock and as a result there is prevented penetration of dirt or dust into the lock casing. The sliding member 441 has a basically U-shaped planar form and is guided with its two legs 442 at the walls of the lock casing limiting the insertion guidance slot for the lock tongue 3. By means of a receiving projection 443, the ejection spring 417 for the lock tongue 3 engages at this sliding member 441.

It will be further seen in the embodiment of FIG. 7 that the recess 444 in the upper covering shell of the lock casing 1, assigned for actuation of the release member 429, is limited to approximately the width of a thumb in order to prevent an unintentional opening of the lock by objects which may impinge in the vicinity of the lock within a vehicle or which are in any way moving, but especially by the arms of passengers in the vehicle.

While specific embodiments of the invention have been shown and described in detail to illustrate the application of the inventive principles, it will be understood that the invention may be embodied otherwise without departing from such principles.

What is claimed is:

1. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween wherein said support surface means are aligned to extend perpendicularly to an insertion plane of said lock tongue means defined by said planar slot, wherein said locking bolt means are formed with projections having abutment surfaces adapted to engage said stop surface means, and wherein said stop surface means and said abutment surfaces of said projections of said locking bolt means enclose an acute angle with said insertion plane of said lock tongue means, inclined against the insertion direction of said lock tongue means.

2. A mechanism according to claim 1 wherein said locking bolt means are formed with wedge-shaped cross-sectional projections, and wherein said stop surface means and said support surface means define an acute angle with an insertion plane of said lock tongue means defined by said planar slot.

3. A mechanism according to claim 1 wherein said stop surface means extend vertically relative to an insertion plane of said lock tongue means defined by said planar slot.

4. A mechanism according to claim 1 wherein said lock tongue means is formed with a pair of recesses on opposite sides thereof and with a lock tongue neck extending between said recesses, said stop surface means being formed to define terminal edges of said recesses, said locking bolt means being arranged with a forked configuration having a pair of said projections extending to opposite sides of said lock tongue neck with said projections being arranged for abutting engagement with said stop surface means.

5. A mechanism according to claim 1 wherein said casing means is formed entirely of steel and includes lateral walls having other parts of said releasable locking mechanism enclosed therein, said other parts enclosed by said lateral walls all being formed of frangible plastic parts.

6. A mechanism according to claim 1 wherein said casing means is formed with a U-shaped configuration having a pair of legs defining lateral walls of said casing means and having a base defined by a supporting plate equal in height to said lateral walls of said casing means, said mechanism further including an ejection spring supported by said casing means for said lock tongue means and a key spring.

7. A mechanism according to claim 1 wherein said casing means includes an upper wall having a recess through which said release member may be engaged for actuation, said recess being dimensioned with a width approximately equal to the width of a human thumb.

8. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, wherein said support surface means are inclined relative to said stop surface means at an angle such that tension applied between said first and second belt members will produce through said lock tongue means a component of force on said locking bolt means lifting said locking bolt means away from said planar slot along said support surface means.

9. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, wherein said casing means is formed with a pair of lateral walls each having a recess therein defined by edges of said casing means, wherein said support surface means are defined by surfaces of said edges defining said recesses in said lateral walls of said casing means, and wherein said locking bolt means is formed from a blank of generally planar material and is arranged in loose engagement for swiveling motion about an upper edge thereof at said support surface means formed in said lateral walls of said casing means.

10. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, said mechanism further comprising a safety member arranged to be movably actuated by said release member, said safety member being slidably moved by said release member in a plane extending parallel to an insertion plane of said lock tongue means defined by said planar slot and intersecting the plane of movement of said locking bolt means.

11. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, wherein said release member is formed with a centrally arranged control member defining a curved control surface and wherein said locking bolt means is formed with a centrally arranged recess located to interact with said control surface, with actuation of said release member operating to urge said locking bolt means away from said planar slot by engagement of said control surface with said central recess.

12. A mechanism according to claim 11 wherein said control surface forms with an insertion plane of said lock tongue means defined by said planar slot a smaller angle than said support surface means.

13. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, said mechanism further comprising a return spring urging said release member away from the release position of said locking mechanism, said return spring being adapted to be stressed by swiveling movement of said locking bolt means during insertion of said lock tongue means into said planar slot, said spring becoming slack when said lock tongue means is completely inserted thereby to create an audible locking indication.

14. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, said mechanism further comprising a flat spring acting upon said locking bolt means in the direction of its release position, said flat spring being held at a distance relative to the plane of movement of said locking bolt means in said casing means, and engaging with a free end thereof at said locking bolt means, the spring tension of said flat spring being at least equal to the sum of the frictional forces counteracting movement of said locking bolt means toward the release position.

15. A mechanism according to claim 14 wherein said flat spring is increasingly upwardly curved starting from an attachment end thereof at said casing means with an increasing distance from said attachment end with said locking bolt means in the release position.

16. A mechanism according to claim 14 wherein said free end engages said locking bolt means with at least the distance from its upper frontal surface corresponding to the material thickness of said locking bolt means.

17. A mechanism according to claim 14 wherein said flat spring is fixed at one end thereof to said casing means with said free end being bent back toward said fixed end and engaging about said locking bolt means with a tab, said tab being in contact with surfaces of said locking bolt means parallel to an upper frontal surface of said locking bolt means.

18. A mechanism according to claim 14 wherein said casing means are formed with lateral walls having recesses therein defined by front edges of said lateral walls outlined with a curved configuration corresponding to an essentially vertically directed path of movement of said locking bolt means and traced by said flat spring holding said locking bolt means.

19. A mechanism according to claim 18 wherein said recesses in said lateral walls of said casing means extend up to the area of said planar slot and include front rims in this area enclosing an acute angle with an insertion plane of said lock tongue means defined by said planar slot, said recess rims directly above said planar slot being engaged in the same inclination direction with a flatter angle relative to said insertion plane of said lock tongue means.

20. A mechanism according to claim 14 wherein said free end projects beyond said locking bolt means with an increasing curved configuration and wherein said release member includes a front wall having an inner surface wherein there is aligned in its longitudinal direction at least one web increasing from top to bottom in a wedge shape.

21. A mechanism according to claim 14 wherein said flat spring is constructed as a straight leaf spring holding said locking bolt means in the release position.

22. A mechanism according to claim 14 or 21 wherein said locking bolt means comprises a straight bolt member guided in an essentially vertical plane moveable between a locking position and a release position in lateral walls of said casing means and wherein the length of said flat spring engaging said bolt member is several times the height of said bolt member.

23. A mechanism according to claim 22 further including a safety member operable to block and unblock movement of said locking bolt means to said release position, a pair of parallel aligned pressure springs forming at the same time a key spring with a spring extremity shoe operating to enable said parallel aligned pressure springs to act upon said safety member, said safety member being arranged to lie in its release position adjacent an upper area of said locking bolt means.

24. A mechanism according to claim 23 wherein said safety member is moveably guided in said casing means against said release member and is acted upon by the force of at least one of said pressure springs.

25. A mechanism according to claim 24 further comprising a sliding member guided in said planar slot and connected ahead of an ejection spring for said lock tongue means, said sliding member during release of said lock tongue means closing an insertion opening of said planar slot through which said lock tongue means is inserted.

26. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, wherein said locking bolt means includes a bent portion extending into said planar slot and aligned at an acute angle relative to said stop surface means with an upper frontal surface thereof aligned parallel to the plane of movement of a web-shaped stop member, slidably guided in guide slots of lateral walls of said casing means parallel to the plane of movement of said lock tongue means, said stop member being slidable in one sliding direction by means of a key spring assigned to said release member and in the other sliding direction directly by means of said release member.

27. A releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, said mechanism further including a movable safety member adapted to block movement of said locking bolt means to a release position, said locking bolt means including an upper area enclosing with the underside of said safety member an angle of 90°.

28. a releasable locking mechanism for safety belts comprising: lock tongue means connected with the end of a first belt member; casing means connected with the end of a second belt member; means defining a generally planar slot for receiving said lock tongue means; stop surface means formed on said lock tongue means; support surface means defined on said casing means extending transversely relative to said planar slot; locking bolt means slidably guided on said support surface means and adapted to extend within said planar slot to engage said stop surface means to lock said tongue means relative to said casing means; and a spring-loaded release member adapted to urge said locking bolt means along said support surface means to release said lock tongue means from locking engagement therewith; said stop surface means and said support surface means being arranged to define an acute angle therebetween, said mechanism further comprising a safety member actuated by said release member to block and unblock the path of movement of said locking bolt means toward a release position, spring means including a spring extremity shoe, said safety member being acted upon by intervention of said spring extremity shoe by at least one pressure spring supported at said casing means against the actuation direction of said release member wherein said release member is engaged in a positive locking manner with said spring extremity shoe.

* * * * *